US005117766A

United States Patent [19]

Nechushtan et al.

[11] Patent Number: 5,117,766

[45] Date of Patent: Jun. 2, 1992

[54] PERSONNEL MARKER

[75] Inventors: Aharon Nechushtan; Oded Nechushtan, both of Kibbutz Hagoshrim, Israel

[73] Assignee: Scopus Light (1990) Ltd., Israel

[21] Appl. No.: 722,213

[22] Filed: Aug. 1, 1991

[30] Foreign Application Priority Data

Aug. 6, 1990 [IL] Israel ..... 95302

[51] Int. Cl.[5] ..... G08B 5/36

[52] U.S. Cl. ..... 116/209; 116/202; 356/3; 356/21

[58] Field of Search ..... 116/202, 209; 340/321, 340/432, 435; 356/3, 20-22; 362/84, 103, 105, 106, 107, 108, 249, 240, 109, 34

[56] References Cited

U.S. PATENT DOCUMENTS 2,330,561 9/1943 Dietrich ..... 340/435
3,083,295 3/1963 Baker ..... 340/321
4,285,029 8/1981 McCoy ..... 362/84
4,599,682 7/1986 Stephens ..... 362/103
4,862,331 8/1989 Hanabusa ..... 362/106

FOREIGN PATENT DOCUMENTS 755777 11/1933 France ..... 340/321
964201 7/1964 United Kingdom ..... 362/84

*Primary Examiner*—William A. Cuchlinski, Jr.
*Assistant Examiner*—W. Morris Worth
*Attorney, Agent, or Firm*—David L. Davis

[57] ABSTRACT

Apparatus for marking the location of a person in conditions of darkness, including a base configured for mounting in association with the person; and apparatus, mounted onto the base, for displaying an image which when viewed at up to a first predetermined distance has a first appearance, and which when viewed from a distance between the first predetermined distance and a second predetermined distance, has a second appearance different to the first appearance.

18 Claims, 5 Drawing Sheets

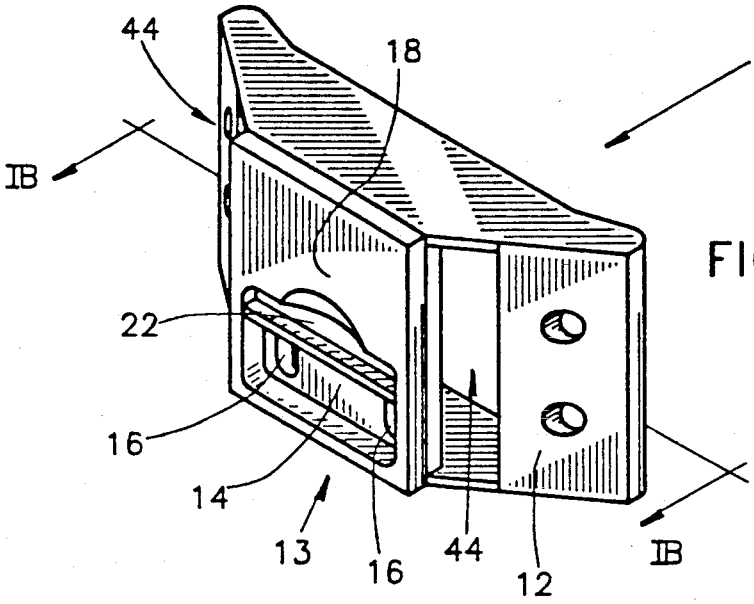
FIG. 1A
FIG. 1B
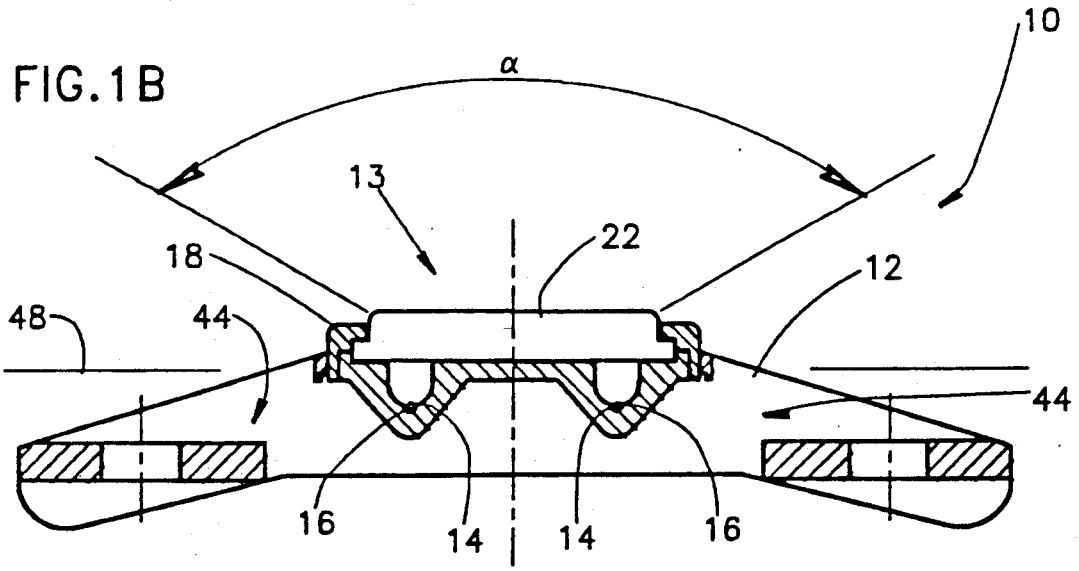

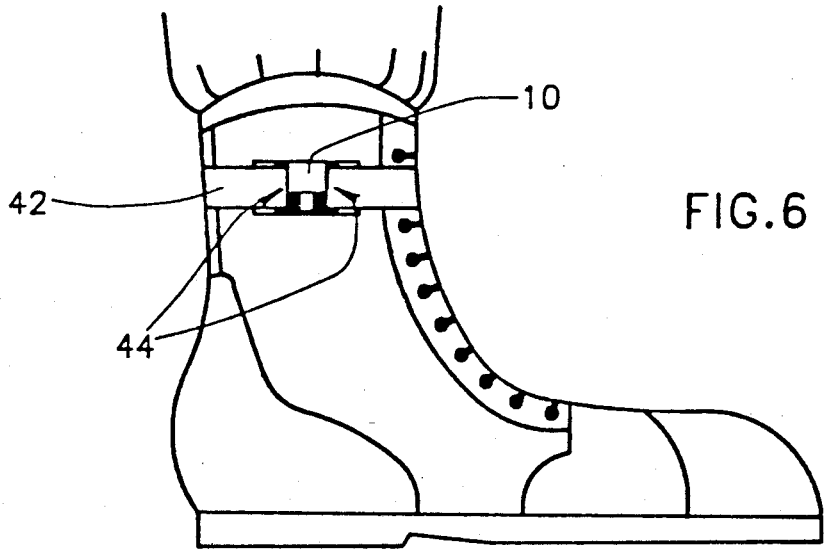
FIG.6
FIG.8
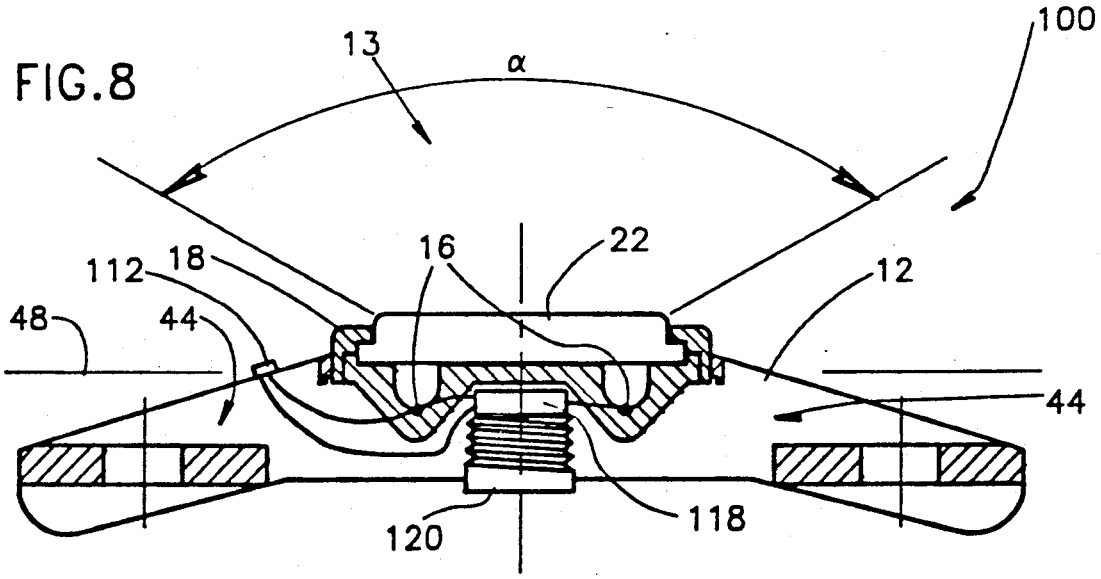

PERSONNEL MARKER

FIELD OF THE INVENTION

The present invention relates to personnel field markers in general and, in particular, to short range, personnel field markers for nighttime use.

BACKGROUND OF THE INVENTION

A problem experienced by military forces operating in conditions of darkness is that of maintaining visual contact between individual soldiers. It is particularly important that visual contact be maintained without, however, alerting an enemy force to the presence of the soldiers.

Similar problems may also be experienced by law enforcement personnel. In the case of hikers, climbers and hunters, for example, although there is no need to ensure non-detection by an enemy, the maintaining of visual contact between individuals may, nonetheless, be necessary.

SUMMARY OF THE INVENTION

The present invention seeks to provide a personnel field marker that may be conveniently carried by an individual, and which enables identification of a person under conditions of darkness.

The present invention also seeks to provide a personnel field marker that enables identification of a soldier, for example, by other soldiers in his force, but which provides no significant risk of his being identified by an enemy force.

There is provided, therefore, in accordance with an embodiment of the invention, apparatus for marking the location of a person in conditions of darkness, including a base configured for mounting in association with the person; and apparatus, mounted onto the base, for displaying an image which when viewed at up to a first predetermined distance has a first appearance, and which when viewed from a distance between the first predetermined distance and a second predetermined distance, has a second appearance different to the first appearance.

Additionally in accordance with an embodiment of the invention, the image is invisible to the naked eye when viewed at a distance beyond the second distance.

Further in accordance with an embodiment of the invention, the apparatus for displaying an image includes a light source, for example, a radioluminous light source.

Additionally in accordance with an embodiment of the invention, there is also provided apparatus for selectably rendering the light source non-visible.

In accordance with an alternative embodiment of the invention, there is provided apparatus for marking the location of a person in conditions of darkness including a base configured for mounting in association with the person, and a radioluminous light source mounted onto the base.

BRIEF DESCRIPTION OF THE DRAWINGS

The present invention will be more fully understood and appreciated from the following detailed description, taken in conjunction with the drawings, in which:

FIGS. 1A and 1B are respective front and sectional views of a personnel field marker constructed in accordance with an embodiment of the invention;

FIG. 6 is a schematic illustration of the marker of the present invention strap-mounted onto a boot;

FIG. 8 is a sectional view illustration of a personnel field marker constructed in accordance with an alternative embodiment of the invention.

DETAILED DESCRIPTION OF THE INVENTION

Figure 2A:
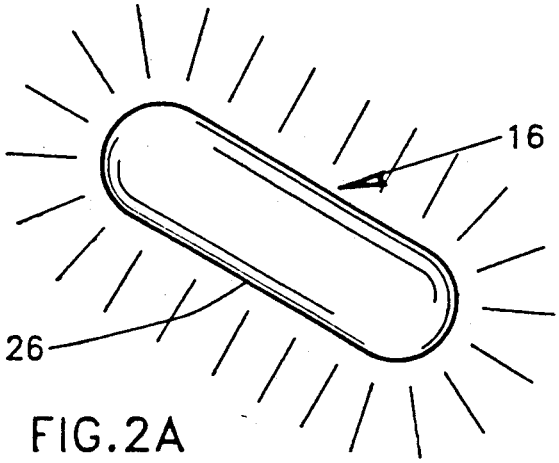
FIGS. 2A and 2B are large scale, schematic perspective and cross-sectional views, respectively, of a single radioluminous light element used in the marker of FIGS. 1A and 1B.

Referring now to FIGS. 1A and 1B, there is shown a personnel field marker, referenced generally 10, for marking the location of a person in conditions of darkness, and constructed in accordance with a preferred embodiment of the present invention. The personnel field marker constitutes a means of marking and identifying a person moving on foot in darkness. Although the use of the marker of the present invention is described throughout in conjunction with soldiers, use of the marker is not intended to be restricted to soldiers only, and it may also be useful to mountaineers, mountain rescue teams, hunters, law enforcement personnel and the like.

Field marker 10 includes a typically buckle-shaped base 12, made typically of a rigid plastic, such as polycarbonate, and configured for attachment to an article of clothing, headgear or footwear as described below in conjunction with FIGS. 4–6. Field marker may also be attached to e.g. an arm or a leg of a person as by the strap shown and described below in conjunction with FIG. 6.

Housed within recesses 14 formed in a central portion of base 12 is a light source, referenced generally 13, typically constituted by a pair of light emitting elements 16. Elements 16 are protected by a cover 18 which is mounted onto the base 12 and which defines a window 20 in optical registration with the elements 16. A typically slidable opaque shield 22 is provided for selectable closure of window 20 and, therefore, selectable obscuration of the light emitting elements 16.

According to the present embodiment, elements 16 may be a pair of radioluminous light emitting elements constructed to emit visible light of a predetermined intensity. Typically, the radioluminous elements are constructed to emit very low intensity light, e.g. of approximately 200–250 microlamberts, so as to have a relatively short visible range, as described below in conjunction with FIG. 7.

Figure 2B:
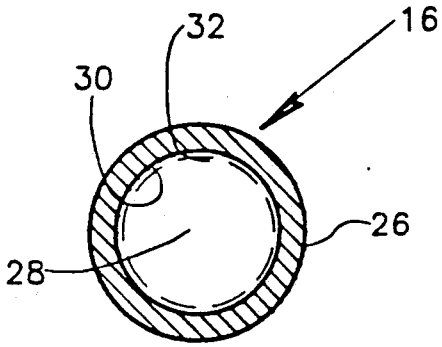

Referring now to FIGS. 2A and 2B, each light emitting element 16 is typically a gaseous tritium light source, also known as a radioluminous light source. According to the present embodiment, therefore, each element 16 comprises a glass vial 26 containing a small amount of tritium gas indicated at 28 (FIG. 2B). The inside wall surface 30 of vial 26 is coated with a thin layer of a phosphorescent material 32. The tritium gas emits charged particles which, when they impinge on the phosphorescent material, provide an uninterrupted source of e.g. green light for a relatively long period, such that field marker 10 has a useful life of at least about six years.

Figure 3A:
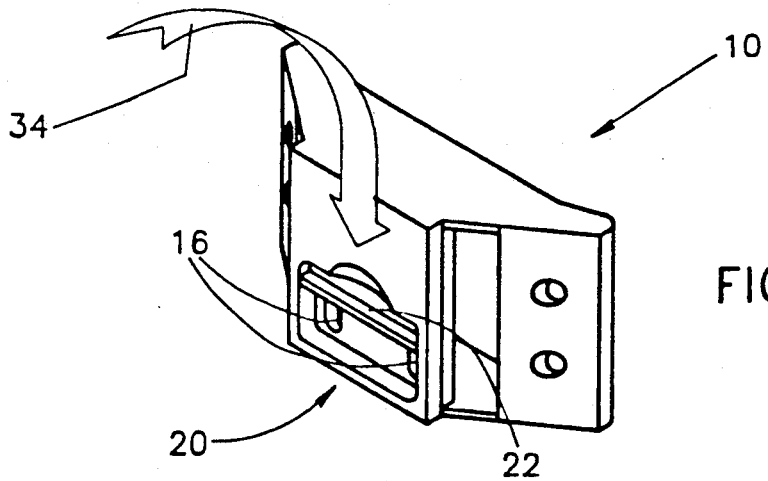
FIGS. 3A and 3B are front views of the marker of FIGS. 1A and 1B in modes of use and nonuse respectively.
Figure 3B:
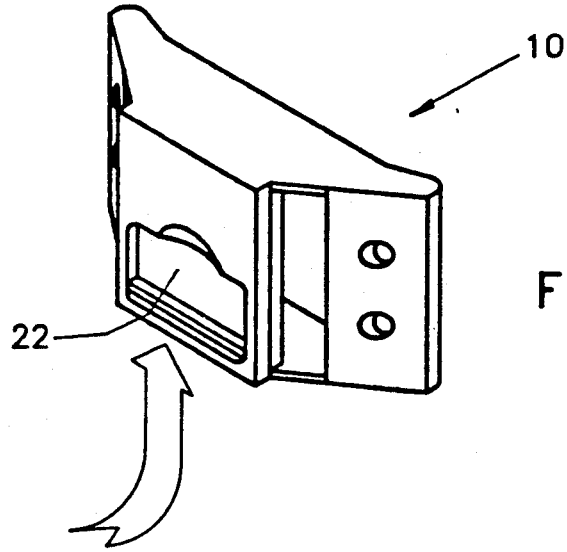

Referring now briefly to FIGS. 3A and 3B, the use of slidable shield 22 is illustrated. In FIG. 3A, the shield is in a raised position such that elements 16 are visible through window 20. Shield 22 may be moved down in the direction indicated by arrow 34 so as to close window 20, as illustrated in FIG. 3B, thereby rendering elements 16 non-visible.

Referring now to FIG. 8, there is illustrated a personnel field marker, referenced generally 100, constructed according to an alternative embodiment of the invention. According to the illustrated embodiment, light emitting elements 16 are light emitting diodes which are powered by one or more miniature electric batteries 118, which are operative to power elements 16 for a relatively extended period. A typical battery useful in the present embodiment is the LR43 1.5 V watch/calculator battery manufactured by RENATA, Switzerland.

A removable cover 120 provides access to cell 118. A switch 112 may also be provided so as to permit disconnection of elements 16 when not in use.

Figure 4:
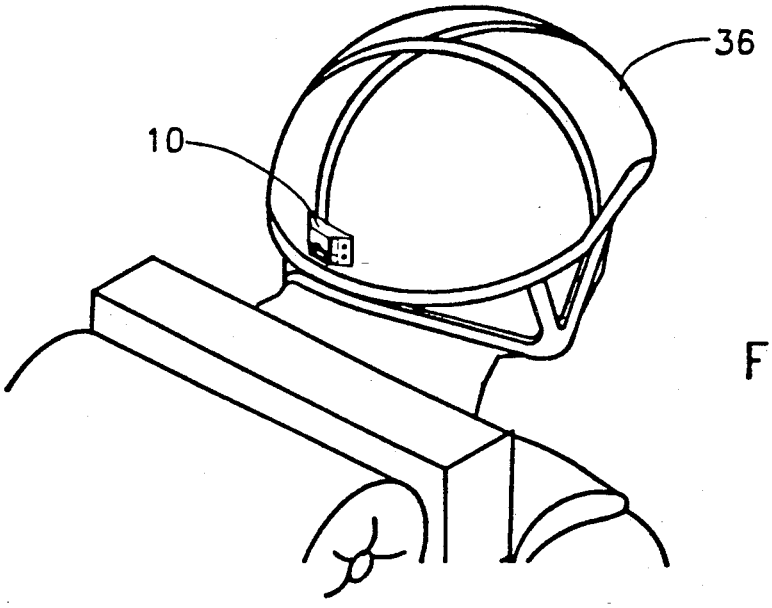
FIG. 4 is a schematic illustration of the marker of the present invention mounted onto a camouflage covering of a helmet.
Figure 5:
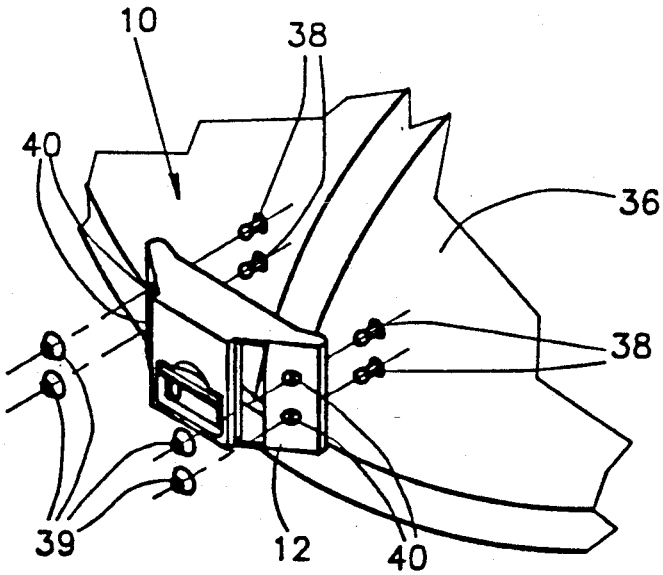
FIG. 5 is an exploded view of a portion of FIG. 4.

Referring now to FIGS. 4-6, as stated, base 12 is configured for attachment to an article of headgear, footwear or clothing, or any other article that may be worn by a person, e.g. a battle vest.

With particular reference to FIGS. 4 and 5, marker 10 is illustrated as being attached to the camouflage covering 36 of a soldier's helmet. Marker 10 may be attached to covering 36 by, for example, a plurality of fastening pins 38 inserted through covering 36 and apertures 40, formed in base 12, for locking engagement with snap rings 39. Any suitable e.g. pin-type fasteners may be used, an example of which is Israel Defense Forces' plastic fastening pins, catalog number 416116008.

Alternatively, as illustrated in FIG. 6, marker 10 may be attached by threading a strap 42 through a pair of openings 44 (FIGS. 1A and 1B), and by subsequent securing of the strap about a boot 44.

Fasteners 38 (FIG. 5), strap 42 (FIG. 6), or any other suitable means may also be used to attach marker 10 to various additional articles of clothing or battle gear, and it is envisaged that more than one marker 10 may be worn. Strap 42 may also be used for attaching marker 10 directly to a limb, such as an arm or a leg.

Figure 7:
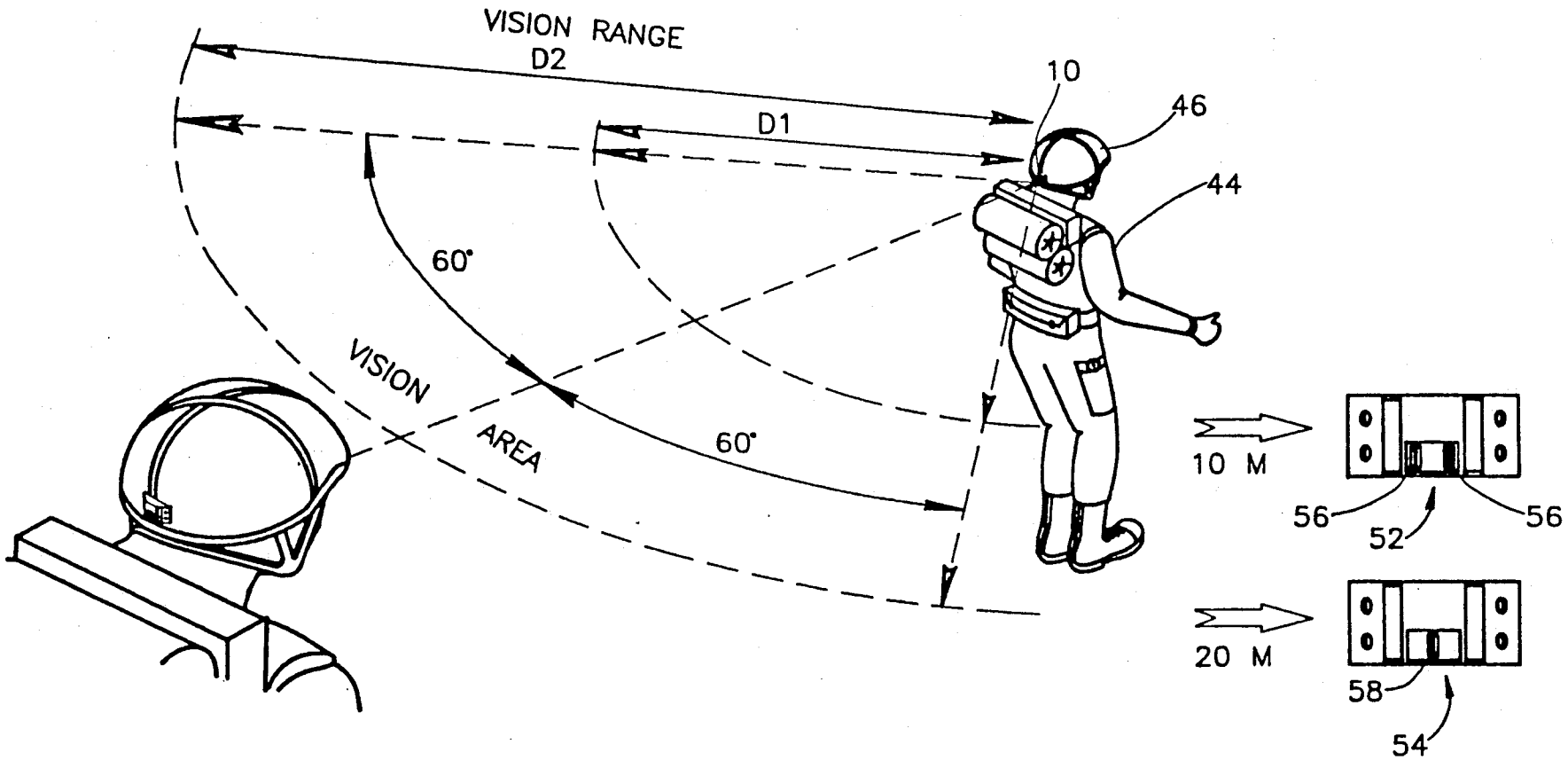
FIG. 7 is a diagrammatic illustration of typical ranges in which the marker apparatus of the invention is visible.

Reference is now made to FIG. 7, which is a diagrammatic illustration of typical ranges in which the marker apparatus of the invention is visible to the naked eye. In the present example, a soldier 44 has a rearwardly projecting single marker 10 attached to the rear of his helmet 46. As stated above, an aim of the present invention is that the marker worn by a soldier be visible only to a fellow soldier, while minimizing the risk of being observed by enemy forces.

Accordingly, the light emitting elements 16 (FIGS. 1B and 8) are arranged within base 12 of the marker such that light emitted therefrom is only visible in a predetermined arc $\alpha$, such that light emitted by the elements 16 is not visible by enemy forces at a location towards which the soldier is progressing. Angle $\alpha$ depends on the thickness of cover 18 and on the depth to which elements 16 are recessed within the base 12. A typical angle $\alpha$ may be approximately 120°. The marker has a longitudinal axis 48 (FIG. 1B) and is intended to be worn such that axis 48 is generally parallel to a ground surface, such that the predetermined arc is approximately horizontal.

In addition to enabling the identification of one soldier by a fellow soldier 50, the provision of more than a single element 16 enables the fellow soldier 50 to determine the approximate distance between himself and soldier 44. The visible image provided by elements 16 has a first predetermined configuration 52 when viewed at up to a first predetermined distance, indicated by D1 in the drawing, and has a second predetermined configuration 54, different to the first configuration 52, when viewed from a distance greater than D1 and up to a second predetermined distance, indicated by D2.

According to the present example, wherein the marker 10 employs a pair of parallel, elongate, light emitting elements 16, each emitting light of intensity of 200-250 microlamberts, each of the elements 16 is distinctly visible at up to a distance of approximately 10 m, such that the first predetermined configuration 52 is a pair of vertical stripes 56. At a distance of between about 10 and 20 m, however, a single stripe only 58 is perceived, as illustrated at 54. At a distance of greater than about 20 m, elements 16 are not visible at all to the naked eye.

It will be appreciated that the various distances at which either of the predetermined configurations is visible depend not only on the intensity of the emitted light but also on the visibility conditions. Furthermore, although a pair of light emitting elements 16 have been described hereinabove, any number of such elements, in any preferred configuration, may be used to provide an indication of the distance from a marker 10 of a person viewing it.

An additional factor in determining the respective ranges at which a single vertical stripe is visible and at which two vertical stripes are visible is the distance between elements 16 within the field marker 10. It will be appreciated that an increase or decrease in the distance between elements 16 provides a corresponding increase or decrease in the range at which two vertical stripes are distinguishable.

It will further be appreciated, by persons skilled in the art, that the scope of the present invention is not limited to what has been specifically shown and described hereinabove by way of example. The scope of the invention is limited, rather, solely by the claims, which follow:

We claim:

1. Apparatus for making the location of a person in conditions of darkness comprising:

a base configured for mounting in association with the person; and means, mounted onto said base, for displaying an image which, when viewed at up to a first predetermined distance, has a first appearance, and which when viewed from a distance between said first predetermined distance and a second predetermined distance, has a second appearance different to said first appearance, said means for displaying being arranged in said base such that said image can only be seen within a predetermined arc less than 180 degrees.

2. Apparatus according to claim 1, and wherein said image is invisible to the naked eye when viewed at a distance beyond said second predetermined distance.

3. Apparatus according to claim 1, and wherein said means for displaying an image comprises a light source.

4. Apparatus according to claim 2, and wherein said means for displaying an image comprises a light source.

5. Apparatus according to claim 3, and wherein said light source is a radioluminous light source.

6. Apparatus according to claim 4, and wherein said light source is a radioluminous light source.

7. Apparatus according to claim 3, and wherein said light source comprises an electrical light source.

8. Apparatus according to claim 4, and wherein said light source comprises an electrical light source.

9. Apparatus according to claim 3, and wherein said light source comprises at least two light emitting elements.

10. Apparatus according to claim 4, and wherein said light source comprises at least two light emitting elements.

11. Apparatus according to claim 9, and wherein each said light emitting element comprises a radioluminous light source.

12. Apparatus according to claim 10, and wherein each said light emitting element comprises a radioluminous light source.

13. Apparatus according to claim 9, and wherein each said light emitting element comprises an electrical light source.

14. Apparatus according to claim 10, and wherein each said light emitting element comprises an electrical light source.

15. Apparatus according to claim 3, and also comprising means for selectably rendering said light source non-visible.

16. Apparatus according to claim 4, and also comprising means for selectably rendering said light source non-visible.

17. Apparatus according to claim 1 and wherein said predetermined arc is approximately 120 degrees.

18. Apparatus according to claim 1 and wherein said predetermined arc is arranged to lie in a horizontal plane.

* * * * *

UNITED STATES PATENT OFFICE

CERTIFICATE OF CORRECTION

Patent No. 5,117,766 Dated June 2, 1992

Inventor(s) Aharon Nechushtan et al

It is certified that error appears in the above-identified patent and that said Letters Patent is hereby corrected as shown below:

In Claim 1, column 4, line 52 of the Patent, change "making" to -- marking --.

Signed and Sealed this

Thirtieth Day of November, 1993

*Attest:*

*Attesting Officer*

Bruce Lehman

BRUCE LEHMAN

*Commissioner of Patents and Trademarks*